343-872 SR
12/18/79 OR 4,179,699

United States Patent [19] [11] 4,179,699
Lunden [45] Dec. 18, 1979

[54] LOW REFLECTIVITY RADOME

[75] Inventor: Clarence D. Lunden, Federal Way, Wash.

[73] Assignee: The Boeing Company, Seattle, Wash.

[21] Appl. No.: 813,065

[22] Filed: Jul. 5, 1977

[51] Int. Cl.[2] ..... H01O 1/42
[52] U.S. Cl. ..... 343/872; 343/911 R
[58] Field of Search ..... 343/705, 708, 872, 911 R

[56] References Cited

U.S. PATENT DOCUMENTS

| | | | |
|---|---|---|---|
| 2,607,009 | 8/1952 | Affel | 343/872 |
| 2,744,042 | 5/1956 | Pace | 343/872 |
| 2,956,281 | 10/1959 | McMillan et al. | 343/872 |
| 3,175,220 | 3/1965 | Schetne | 343/872 |
| 3,254,345 | 5/1966 | Hannan | 343/911 R |
| 3,633,206 | 1/1972 | McMillan | 343/872 |
| 3,780,374 | 12/1973 | Shibano | 343/872 |

FOREIGN PATENT DOCUMENTS

| | | | |
|---|---|---|---|
| 1043125 | 3/1963 | United Kingdom | 343/872 |

*Primary Examiner*—Eli Lieberman
*Attorney, Agent, or Firm*—Thomas H. Murray; Clifford A. Poff

[57] ABSTRACT

A low reflectivity radome includes an enclosure wall made of foamed plastic material defining a dielectric constant of about 1.08. Stiffening ribs made from reinforced glass fibers with a dielectric constant of about 4.0 are arranged in an orthogonal manner along planes normal to a tangent to the air-side surface of the radome and at least partially embedded in the enclosure wall for compressive strengthening thereof. Different orthogonal arrangements include the ribs being totally embedded within the enclosure wall, the ribs projecting to uniform or different distances from the inside surface of the enclosure wall or the ribs are arranged in closely, spaced-apart pairs and project from the inside surface of the enclosure wall. When the ribs are totally embedded in the formed plastic material, the distance between the ends of the ribs and each face surface of the enclosure is selected so that incident microwaves undergo identical phase shifts for all parallel paths through the enclosure wall. The formed plastic material of the enclosure is coated on the air-side surface with matching conductive paint. On the inside surface, quarter-wave ribs are formed within the dielectric material for interface matching.

10 Claims, 10 Drawing Figures

LOW REFLECTIVITY RADOME

BACKGROUND OF THE INVENTION

This invention relates to a low reflectivity radome for enclosing and protecting a radar antenna, particularly the type carried by aircraft. The present invention is more particularly addressed to employing foamed plastic materials stiffened with ribs made from materials having a substantially greater dielectric constant but extending normal to the surface of such a radome in an orthogonal arrangement for very low reflectivity to minimize side-lobe clutter and side-lobe jamming.

Conventional radomes are designed on the basis of a compromise between desired electrical and structural properties. For ideal electrical performance, and beam passing to and from the radar antenna should be entirely unaffected by the radome. The only way this can be accomplished is unacceptable, namely, to eliminate the radome entirely. For airborne radar, the structural configuration of the radome is of utmost importance to not only the function of the radar itself but also the aerodynamic shape of the radome on the aircraft. Common types of radomes include conventional fiberglass A- and C-type sandwiches which are satisfactory from the weight/stiffness aspect but prohibit attainment of reflectivity lower than, for example, −25 to −30 db. Typical fiberglass sandwiches with glass cloth resin walls and honeycomb openings between them provide a nearly-ideal distribution of stiffness but unfortunately the distribution of refractivity is highly unsatisfactory. Ideally, the refractivity should be substantially at a maximum in the center of the radome to pass the microwave through the radome with a minimal reflection.

The fundamental underlying concept of radome designs for decades has been to optimize the fiberglass sandwich structure by better resins, better adhesives, and improved computer programs to predict radio-frequency performance. However, radome walls having a dielectric constant of approximately $\epsilon=4$ lying parallel to the E-field will have reflections of intolerable levels for certain electronic systems.

SUMMARY OF THE INVENTION

It is an object of the present invention to provide a radome in the form of a stiffened foamed plastic wall to achieve lower radome reflections by a construction which achieves better E-field distribution than that afforded by conventional radomes made from fiberglass sandwiches.

It is a further object of the present invention to provide a low reflectivity radome for a radar antenna by using foamed plastic material having a low dielectric constant to produce an enclosure and arranging ribs made from resin-bonded glass fibers having a substantially greater dielectric constant perpendicular to the incident E-field.

It is a still further object of the present invention to provide a low reflectivity radome for a radar antenna wherein the enclosure wall is formed from foamed plastic material and stiffeners, when necessary, are arranged to extend normal to a tangent to the air-side surface of the enclosure wall to achieve a far superior distribution of electrical reflectivity; the arrangement being such that the foamed plastic material provides a smooth aerodynamic air-side surface and stabilizes the stiffeners from buckling under compression which are arranged either as protrusions from the inside surface or totally embedded within the enclosure wall.

According to the present invention, a low reflectivity radome for a radar antenna essentially includes an enclosure wall consising of foamed plastic material which defines a smooth air-side surface and a concave inner surface, and a plurality of stiffener ribs each consisting of resin-bonded glass fibers and disposed to compressively strengthen the enclosure wall by extending in an orthogonal manner along planes normal to tangents to the air-side surface while the ribs are at least partially embedded within the enclosure wall.

The aforementioned ribs are wholly embedded within the enclosure wall according to one embodiment of the invention while according to other embodiments, the ribs project from the concave inner surface of the enclosure wall. In one arrangement, each rib extends from the concave inner surface and spaced from the air-side surface by the distance x given by the expression:

$$X = \frac{\lambda_o}{4\sqrt{\epsilon_f}} SEC\, i \qquad (1)$$

where:

$\lambda_o$=the design radar wavelength, $\epsilon_f$=the dielectric constant of the foamed plastic material, and i=the design incidence angle.

In another aspect, the ribs project from the concave inner surface of the enclosure wall by distances that alternate in magnitude from rib-to-rib for interface matching of the incident radar electromagnetic energy. In still another arrangement, the ribs are disposed in pairs at closely-spaced, side-by-side intervals to project from the concave inner surface for minimizing grating lobes. The ribs may take the form of flat, plate-like members or, alternatively, hollow tubular members formed from resin-bonded glass fibers may be used. In still another aspect of the present invention, such hollow tubes of resin-bonded glass fibers are used to join segmental parts of foamed plastic material to form the enclosure wall of the radome. The radome may additionally include a film of conductive paint applied to the air-side surface of the enclosure wall for reducing reflection of microwaves leaving the air-side surface of the radome.

In still another aspect of the present invention, there is provided a low reflectivity radome characterized for a radar antenna wherein the radome essentially includes an enclosure wall consisting of foamed plastic material defining a smooth air-side surface and an oppositely-facing inner surface within which there is defined parallel projecting ribs integral with the enclosure wall for matching the interface at the enclosure wall and a layer of conductive paint covering the air-side surface of the enclosure wall for matching the interface of the air-side surface.

The aforementioned parallel projecting ribs at the inner surface of the closure wall have a pitch that is preferably less than or equal to one-half the design wavelength of radar microwaves. More specifically, the aforementioned ribs formed in the foamed plastic material at the inside surface of the enclosure wall project inside a distance, t, given by the expression:

$$t = \frac{\lambda_o}{4\sqrt{\epsilon_f}} \quad (2)$$

where:

$\lambda_o$ is the design radar wavelength, and $\epsilon_f$ is the dielectric constant of the foamed plastic material of the enclosure wall.

These features and advantages of the present invention as well as others will be more fully understood when the following description is read in light of the accompanying drawings, in which:

FIG. 1 is a transverse sectional view taken along the center plane of a radom and a radar antenna carried by an aircraft;

FIG. 2 includes an enlarged sectional view taken along line II—II of FIG. 1 and illustrating one embodiment of a radome construction according to the present invention, and graphs A and B of which graph A illustrates desired and actual reflectivity of the radome and graph B illustrates desired and actual relative stiffness of the radome structure;

Figure 1:
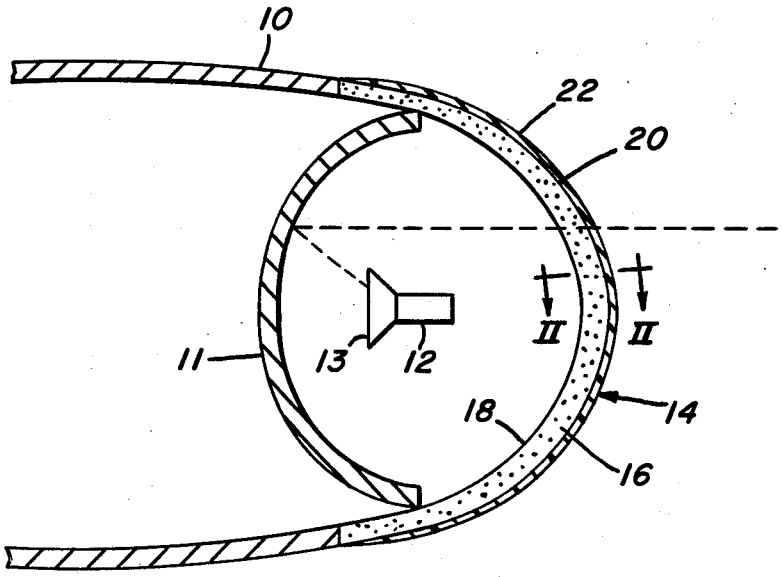

In FIG. 1, there is illustrated the metallic fuselage skin 10 of an aircraft which defines an opening within which there is located a metallic reflector 11 forming part of a radar antenna. A waveguide 12 is coupled to a horn 13 to propagate electromagnetic wave energy toward the reflector 11 and thence toward a radome 14. The radome is hemispheric or other configuration suitable for providing an aperture seal for the opening in the fuselage skin 10. The radome is secured to the fuselage skin by suitable well-known means.

It is a feature of the present invention to produce the enclosure wall 16 of the radome from foamed plastic materials and suitably reinforced by stiffening members where necessary such that the stiffening members lie normal to the air-side surface of the radome to minimize side-lobe clutter, side-lobe jamming and provide very low reflectivity. Polypropylene is the preferred foamed plastic material to form the enclosure wall. This material has a dielectric constant of 1.08 which, because of its near-unity, provides a more ideal dielectric constant as compared with the usual dielectric constant of 4.0 in regard to resin-reinforced glass fibers. Polypropylene foamed plastic material has a density of about 3.5 pounds per cubic foot and has excellent strength, moisture resistance and temperature resistance compared with other foam materials. The foamed plastic material forming the enclosure wall 16 of the radome when formed into a desired aerodynamic configuration defines a concave inner surface 18 and a smooth air-side surface 20 onto which there may be applied, if desired, a thin film 22 of conductive, metallic paint. Such a paint has a resistivity in ohms per square centimeter of approximately $$R = \frac{120\pi}{\sqrt{\epsilon_f - 1}} \quad (3)$$

where:

$120\pi$ is a constant, and $\epsilon_f$ = the dielectric constant of the paint.

The resistivity of the paint film to electromagnetic waves at radar frequency is, in general, different from the direct current resistivity by several orders of magnitude. The film of paint 22 is employed according to the present invention to reduce microwave reflections at the foamed wall-to-air boundary of the radome in regard to microwaves leaving the wall at its air-side. The film of paint may also be employed for the usual static bleeding purposes.

Figure 2:
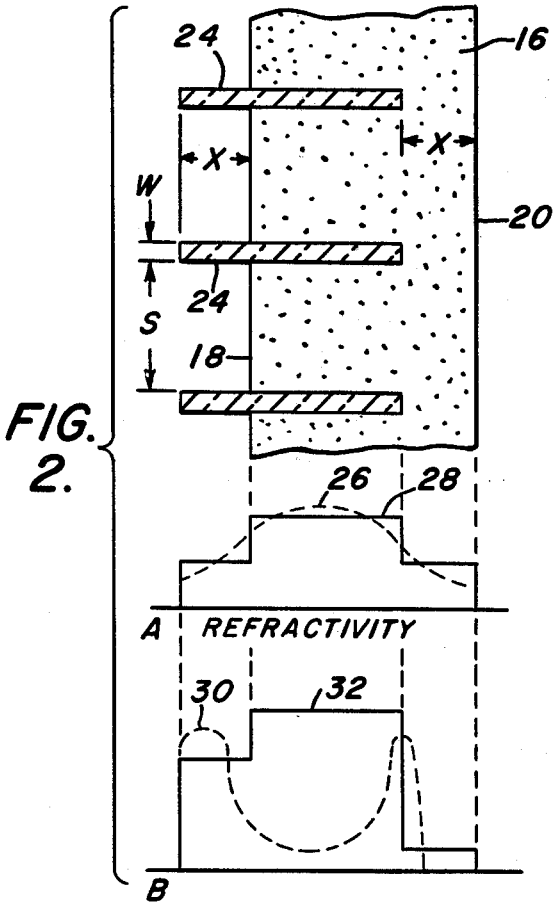
Figure 10:
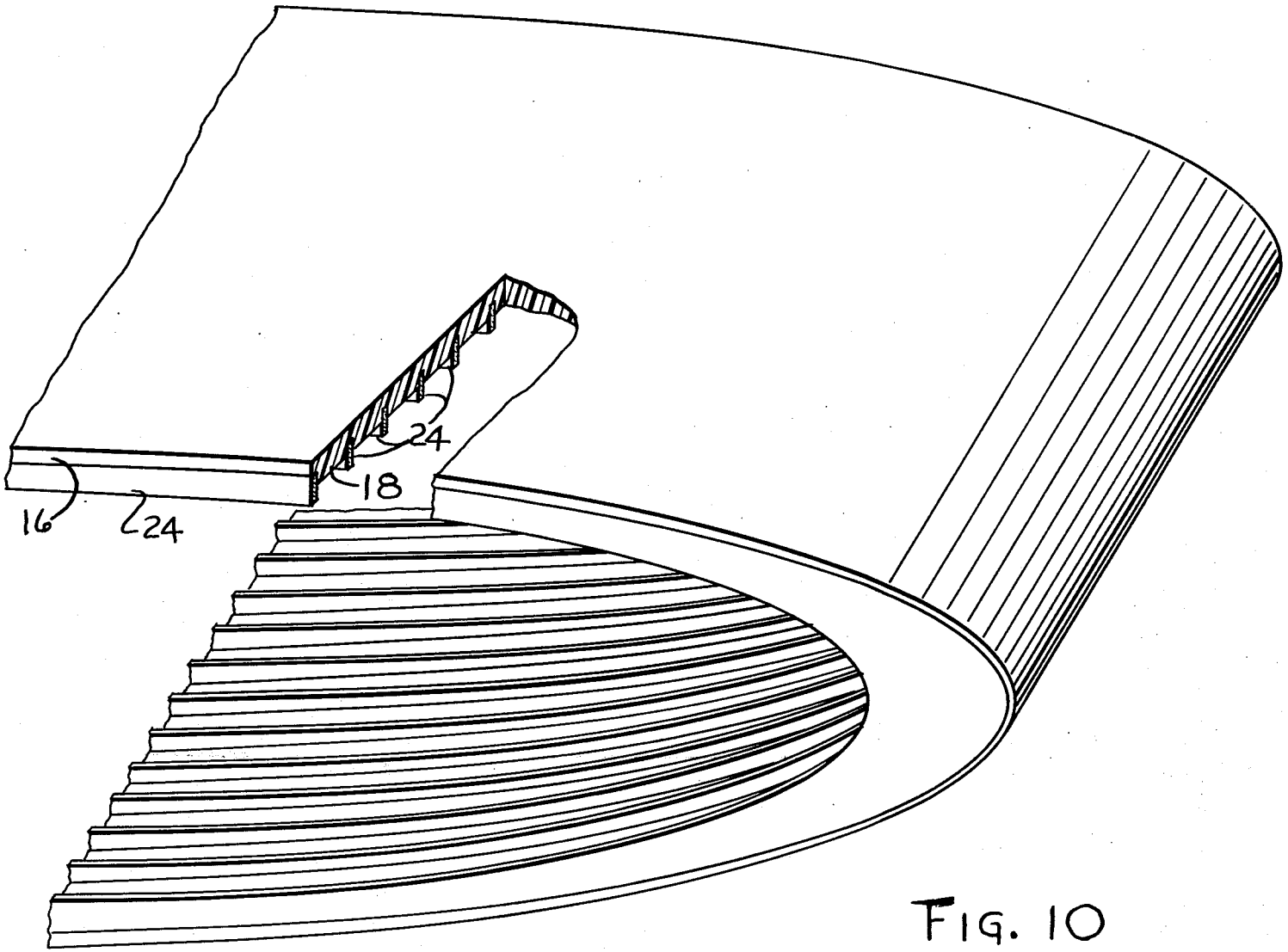
FIG. 10 is an enlarged isometric view, partly in section, of a radome according to the embodiment of FIG. 2.

FIGS. 2–6 and 10 illustrate various arrangements of stiffeners which, when employed according to the present invention, are each arranged to extend along a plane that is perpendicular to a tangent to the air-side surface of the radome. The material used to form such stiffeners is resin-bonded glass fibers. The material has a dielectric constant of about $\epsilon = 4.0$. By arranging the stiffeners so that they extend along planes perpendicular to the air-side surface of the radome, a far better compromise is achieved. Specifically, the usual compromise required in the past between stiffness and refractivity is improved because a far better distribution of electrical refractivity is realized. Stiffness is lower but still acceptable for most airborne applications. In FIGS. 2 and 10, the stiffeners are in the form of plate-like ribs 24 which are spaced-apart by a distance, S, and have a thickness, W. The ribs, as discussed previously, are made from resin-bonded glass fibers. The ribs 24 are partially embedded within the foamed plastic forming the enclosure wall 16 where the embedded ends of the ribs are spaced from the air-side surface by a distance, X, and the ribs project from the inside surface 18 by the same distance, X. The magnitude of the distance, X, is chosen to provide an entrance and exit transformer according to the expression:

$$X = \frac{\lambda_o}{4\sqrt{\epsilon_f}} SEC\, i \quad (4)$$

where $\lambda_o$ equals design radar wavelength. Moreover, the thickness, W, is chosen within the range of 0.031 inch to 0.062 inch. With these dimensional parameters, the expression W/S is less than 0.1. In graph A of FIG. 2, graph line 26 represents the ideal refractivity across the thickness of the radome 10. Graph line 28 represents the actual refractivity across the reinforced radome. The refractivity at each boundary area given by distance, X, is essentially the same and closely approximates the ideal reflectivity which is shown by corresponding portions of graph line 26. The reflectivity is increased by the combination of foamed plastic material and the relatively dense stiffening ribs as shown by a central, stepped refractivity increase in graph line 28 which also approximately corresponds to an ideal increase in reflectivity. The ideal and actual relative stiffness of the radome in cross section is indicated in graph B by graph lines 30 and 32, respectively, where it can be seen that the thickness, X, of only foamed plastic material has a relatively low stiffness while the area of the radome where the foamed material, reinforced by the stiffening ribs, is materially increased relative to the ideal stiffness of the radome. The actual stiffness decreases slightly at the inside surface 18 of the radome where the projecting portions of the ribs are not stabilized by the foamed plastic material. The rib protrusion on the inside surface of the radome gives rise to no problems in regard to the use of the radome; however the foamed plastic material forming the actual wall of the radome serves to stabilize the stiffeners from buckling under compression. Testing has shown the resistance to in-flight hail damage and rain erosion is satisfactory. The radome structure of the present invention is about 50% heavier and about 1.5 to 2 times thicker than comparable fliberglass radomes but exhibits about one-half the refraction and with a far superior dielectric distribution which assures at least 10 db lower reflectivity particularly near grazing incidence. The polypropylene foam is, if desired, injected-molded into and around an orthogonal grid arrangement of fiberglass stiffeners.

Figure 3:
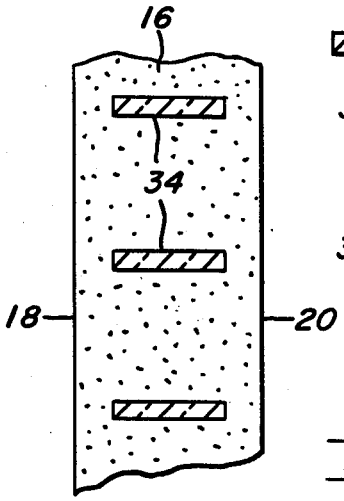
FIG. 3 is a sectional view similar to FIG. 2 but illustrating a further embodiment of the present invention.
Figure 4:
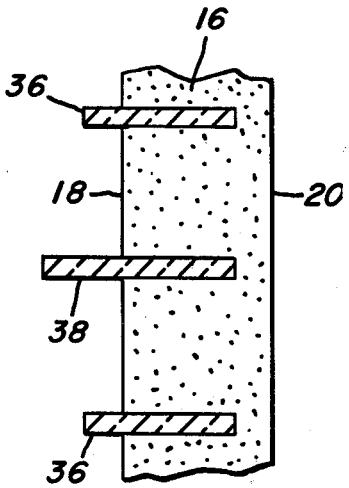
FIG. 4 is a sectional view similar to FIG. 2 but illustrating a still further embodiment of the present invention.
Figure 5:
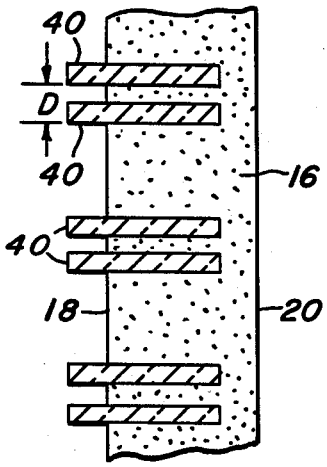
FIG. 5 is a sectional view similar to FIG. 2 but illustrating yet another embodiment of the present invention.

FIG. 3 illustrates a modified arrangement of stiffener ribs 34 which are wholly embedded within the wall of foamed plastic material forming the enclosure wall 16 of the radome. Alternatively, as shown in FIG. 4, stiffener ribs 36 and 38 are of different lengths and embedded to different depths within the enclosure wall 16 of foamed plastic material. The ribs 36 and 38 project from the inner surface 18 of the enclosure wall 16 to distances which alternate in magnitude from rib-to-rib for interface matching of the incident radar electromagnetic energy. FIG. 5 illustrates a still further arrangement of stiffener ribs 40 wherein two stiffener ribs are disposed at closely-spaced, side-by-side intervals, D, while the pairs of stiffener ribs 40 are spaced by a much greater distance from each other. The projecting portions of the ribs from the inside surface of the enclosure wall and the double arrangement of ribs minimize grating lobes.

Figure 6:
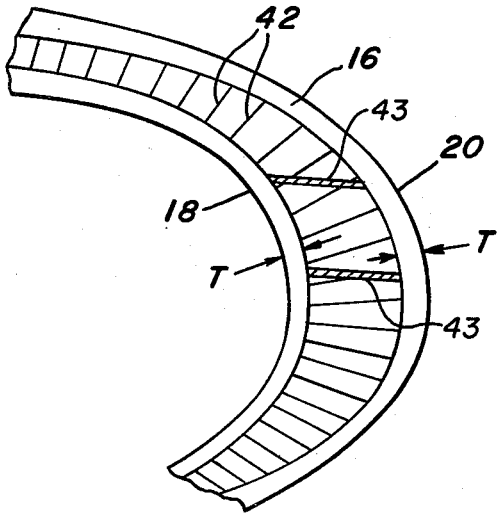
FIG. 6 is an enlarged partial view similar to FIG. 1 but illustrating a preferred arrangement of stiffeners within a radome according to the present invention.

FIG. 6 illustrates, according to the present invention, a phase-correct radome for situations requiring low reflectivity and flat-phase correction over a limit scan angle range. The radome wall 16 is made of foamed plastic material as before and defines the air-side surface 20 which is convex and an inside surface 18 which is concave. The thickness of the enclosure wall is tapered and the radome may be parabolic with a maximum thickness of the radome wall at the axis of the parabola and tapering therefrom in a manner of reduced thickness. The stiffener ribs 42 are wholly embedded within the foamed plastic material. The terminal ends of the ribs are spaced from the air-side surface and the inside surface by a distance, T, which varies about the surface of the enclosure wall. The boundary thickness of foamed plastic material between the terminal ends of the reinforcing ribs and the surfaces of the enclosure wall is given by the expression:

$$T = \frac{\lambda_o}{4\sqrt{\epsilon_f}} SEC\, i \qquad (5)$$

where:

$\lambda_o$ = the design radar wavelength, $\epsilon_f$ = the dielectric constant of foamed plastic material, and $i$ is the design incidence angle.

The bulk thickness of the radome wall is constrained so that for all parallel paths of incident radar waves as indentified in FIG. 6 by reference numeral 43, there is identity of phase. In this embodiment, the bulk thickness of the radome is constrained only by the stiffness and phase correction not by interface matching which is such that all intramural phase paths are equal.

Figure 7:
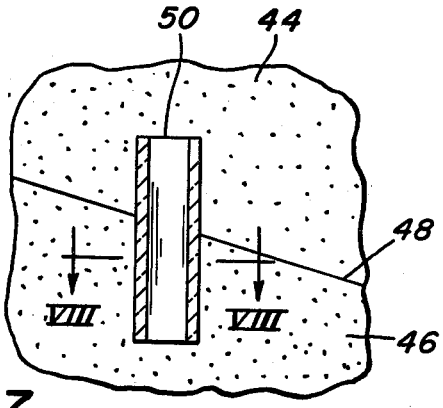
FIG. 7 is an enlarged view of a segment of a radome showing the interconnection between radome sections by a tubular member according to the present invention.
Figure 8:
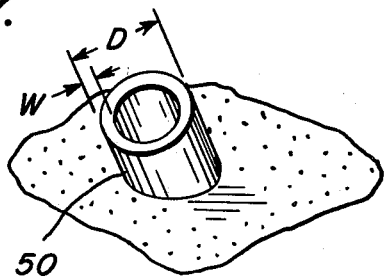
FIG. 8 is a sectional view taken along line VIII—VIII of FIG. 7.

FIGS. 7 and 8 illustrate a still further aspect of the present invention which is applicable not only to joining together divided parts of an enclosure wall for a radome made from foamed plastic material but also a construction and arrangement of stiffening members made in the form of hollow tubes. As illustrated, an enclosure wall for a radome is made up of component sections 44 and 46 which are joined together along a match line 48 by a tubular stiffener member 50. Member 50 extends an equal distance within each component section 44 and 46 for stiffening and joining the parts together. The tubular stiffener members 50 may be used in place of the ribs heretofore described in regard to the embodiments of FIGS. 2–6. The tubular stiffener member 50 consists of a hollow plastic tube made from resin-bonded glass fibers. A pilot hole may be provided within the foamed plastic material of the radome wall to facilitate embedding the plastic tube within the foamed material. The lack of foam in the center of the tube is approximately compensated for by the higher refractivity ($\epsilon$=4.0) of the resin-bonded glass fibers forming the walls of the tube in accordance with the empirical relation $$\frac{W}{D} \sim \frac{\epsilon_f - 1}{\epsilon_t - 1}$$

where:

W = the wall thickness of the tube 50,

D = the outside diameter of the tube 50, $\epsilon_f$ is the dielectric constant of the foamed plastic material forming the radome wall, and $\epsilon_t$ is the dielectric constant of the material forming the wall of tube 50.

By employing the tubes 50 for either reinforcing or stiffening the foamed plastic material, the tube has virtually no adverse affects to the radar beam in a radome structure.

Figure 9:
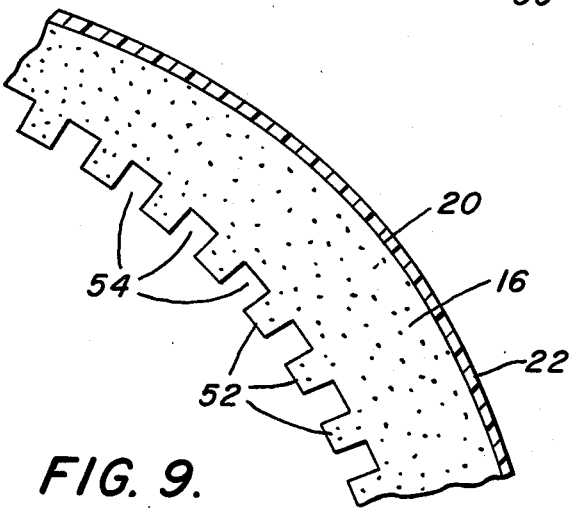
FIG. 9 is an enlarged sectional view similar to FIG. 1 but illustrating a still further modified embodiment of the present invention.

FIG. 9 illustrates a still further modified form of a radome according to the present invention wherein the wall 16 of the radome essentially consists of the foamed plastic material as described hereinbefore but without incorporating rib members. A layer 22 of surface matching conductive paint is applied to the air-side surface of the enclosure wall 16. The conductive paint has a resistivity as described previously by expression (3). The inside surface of the enclosure wall is formed with parallel ribs 52 separated by void areas 54 which are molded or otherwise formed in the foamed plastic material of wall 16. The ribs 52 are used to provide quarterwave surface openings on the inside interface of the radome for interface matching. The pitch of the ribs is less than $\lambda_o/2$ to avoid grating side-lobes and the ribs project by a distance $$\frac{\lambda_o}{4\sqrt{\epsilon_f}}$$

where $\lambda_o$ and $\epsilon_f$ are as before.

Although the invention has been shown in connection with certain specific embodiments, it will be readily apparent to those skilled in the art that various changes in form and arrangement of parts may be made to suit requirements without departing from the spirit and scope of the invention.

I claim as my invention:

1. A low reflectivity radome for a radar antenna, said radome essentially including an enclosure consisting of foamed plastic material, said enclosure defining a smooth air-side surface and a concave inner surface, and a plurality of stiffener ribs each consisting of resin-bonded glass fibers, each of said ribs being disposed to compressively strengthen and reinforce said enclosure against buckling under compression by extending in an orthogonal manner along a plane normal to a tangent to said air-side surface and at least partially embedded within said enclosure, said ribs being spaced apart and spaced from both the air-side surface and the concave inner surface of said enclosure to reduce microwave reflections.

2. The radome according to claim 1 wherein said enclosure defines a dielectric constant of approximately 1.08.

3. The radome according to claim 1 wherein the foamed plastic material forming said enclosure is polypropylene.

4. The radome according to claim 1 wherein the dielectric constant of each of said ribs is approximately 4.0.

5. The radome according to claim 1 wherein each of said ribs is further characterized by the relation $$W/S \approx 0.1$$

where:

W = the thickness of a rib, and

S = the space between adjacent ribs.

6. The radome according to claim 5 wherein the thickness of each rib lies within the range of 0.031 inch and 0.062 inch.

7. The radome according to claim 1 wherein each of said ribs projects from said concave inner surface by a distance given by the expression $$\frac{\lambda_o}{4\sqrt{\epsilon_f}} SEC\ i$$

where $\lambda_o$ equals the radar wavelength, $\epsilon_f$ is the dielectric constant of said enclosure and i is the design incidence angle.

8. The radome according to claim 7 wherein the embedded portion of each of said ribs terminates at a distance from said air-side surface given by the expression $$\frac{\lambda_o}{4\sqrt{\epsilon_f}} SEC\ i.$$

9. The radome according to claim 1 wherein said ribs project from said concave inner surface by distances that alternate in magnitude from rib-to-rib for interface matching of incident radar electromagnetic energy.

10. The radome according to claim 1 wherein said ribs are disposed in pairs at closely-spaced, side-by-side intervals and project from said concave inner surface for minimizing grating lobes.

* * * * *